US005570491A

United States Patent [19]

Tung

[11] Patent Number: 5,570,491

[45] Date of Patent: Nov. 5, 1996

[54] RETRACTABLE HANDLE LOCATING STRUCTURE

[76] Inventor: Chen C. Tung, No. 7, Lane 145, Te Hsing Rd., Ta Chia, Taichung, Taiwan

[21] Appl. No.: 563,275

[22] Filed: Nov. 28, 1995

[51] Int. Cl.[6] ..... B25G 1/04

[52] U.S. Cl. ..... 16/115; 190/18 A; 190/115

[58] Field of Search ..... 16/115, 110 R; 190/18 A, 39, 115, 117

[56] References Cited

U.S. PATENT DOCUMENTS 5,371,922 12/1994 Chern et al. ..... 16/35 R

*Primary Examiner*—Chuck Y. Mah

[57] ABSTRACT

A retractable handle locating structure which includes two sleeves, two sliding tubes slidably inserted into the sleeves and joined by a transverse handgrip outside the sleeves, and two gravity-induced locating elements mounted inside the sliding tubes for locking the sliding tubes, each gravity-induced locating element including a heavy pendulum pivoted to the inside of one sliding tube, and a curved locating rod having a fixed end connected to the heavy pendulum, and a free end inserted into one locating hole on one sliding tube and, the free end of each curved locating rod being forced in and out of one of a longitudinal series of locating holes on one sleeve by the gravity weight of the respective heavy pendulum when the travel bag is tilted.

2 Claims, 2 Drawing Sheets

RETRACTABLE HANDLE LOCATING STRUCTURE

BACKGROUND OF THE INVENTION

The present invention relates to the retractable handle of a wheeled travel bag, and relates more particularly to a gravity-induced locating element pivotably mounted inside each sliding tube of the retractable handle for locking it in an extended position.

A wheeled travel bag generally has a retractable handle for easy moving by hand. A retractable handle for this purpose is generally comprised of two sleeves fixedly secured to the back side of the wheeled bag in a parallel relation, two sliding tubes slidably inserted in the sleeves, a transverse handgrip connected between the sliding tubes at one end outside the sleeves, and spring-supported locating devices respectively mounted inside the sliding tubes for locking the sliding tubes in an extended position. The spring-supported locating devices are complicated in structure, expensive to manufacture, and difficult to install. Furthermore, they must be operated by both hands at the same time.

SUMMARY OF THE INVENTION

The present invention has been accomplished to provide a retractable handle locating structure which eliminates the aforesaid drawbacks. It is therefore one object of the present invention to provide a retractable handle locating structure which is simple in structure. It is another object of the present invention to provide a retractable handle locating structure which is easy to operate. It is still another object of the present invention to provide a retractable handle locating structure which is operated by force of gravity.

According to the preferred embodiment of the present invention, the retractable handle locating structure comprises two sleeves fixedly secured to the back side of a wheeled travel bag and disposed in a parallel relation, each sleeve having a longitudinal series of locating holes, a substantially U-shaped retracting handle having two sliding tubes slidably inserted into the sleeves and a transverse handgrip connected between the sliding tubes outside the sleeves, and lock means for locking the sliding tubes in an extended position relative to the sleeves, wherein the sleeves each has a longitudinal series of locating holes for engagement with the lock means; the lock means comprises two gravity-induced locating elements respectively mounted inside the sliding tubes, each gravity-induced locating element comprising a heavy pendulum having a fixed end pivotably connected to a pivot hole on one sliding tube and a free end connected with a curved locating rod, the curved locating rod having a fixed end connected to the heavy pendulum and a free end inserted into a locating hole on the respective sliding tube, the free end of the curved locating rod being forced in and out of one of the longitudinal series of locating holes on one sleeve by the gravity weight of the heavy pendulum when the travel bag is moved between a standing position perpendicular to the ground and a tilted position.

DETAILED DESCRIPTION OF THE PREFERRED EMBODIMENT

Figure 1:
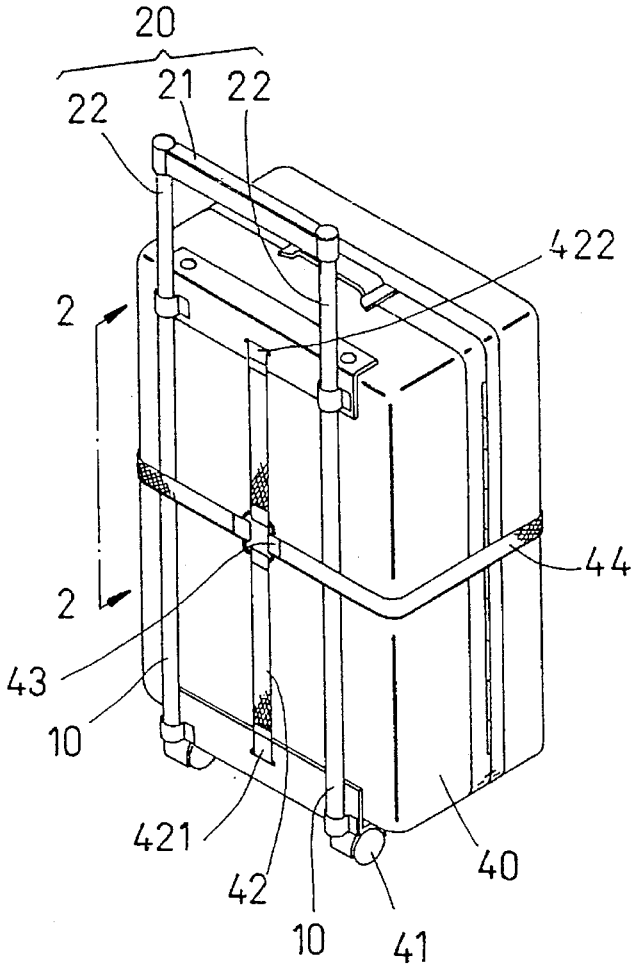
FIG. 1 is an installed view of a retractable handle locating structure according to the present invention.
Figure 2:
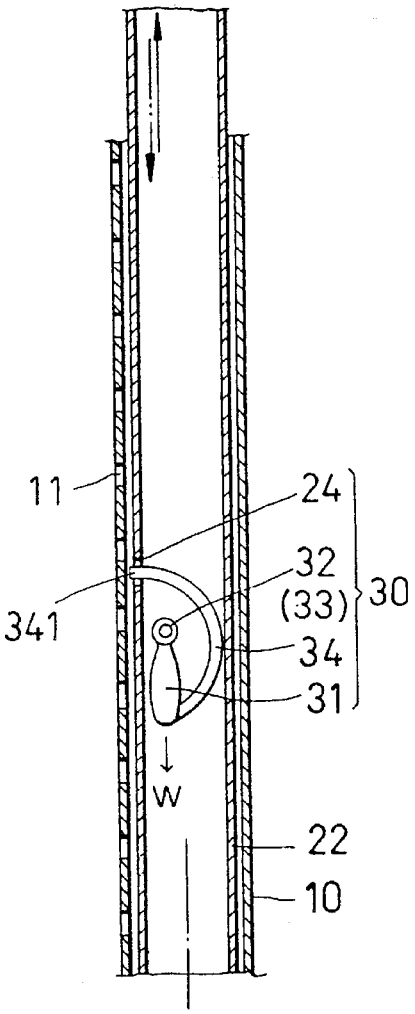
FIG. 2 is sectional view showing the sleeve disposed in a vertical position, and the sliding tube moved in the sleeve according to the present invention.

Referring to FIGS. 1 and 2, a retractable handle locating structure in accordance with the present invention is comprised of two fixed sleeves 10 disposed in a parallel relation, a substantially U-shaped retracting handle 20, and two gravity-induced locating elements 30. The sleeves 10 are fixedly secured to the back side of a travel bag 40, each having a longitudinal series of locating holes 11. Wheels 41 are mounted on the bottom side of the travel bag 40 to make it easy to move. The retracting handle 20 comprises two sliding tubes 22 slidably inserted into the sleeves 10, and a transverse handgrip 21 connected between the two sliding tubes 22 at one end outside the sleeves 10. Each of the sliding tubes 22 has a pivot hole (not shown) near the bottom end, and a locating hole 24 at a higher elevation than the pivot hole. The gravity-induced locating elements 30 are respectively cast from metal, each comprised of a heavy pendulum 31 having a pivot hole 32 at one end pivoted to the pivot hole of one sliding tube 22 on the inside by a pivot 33, and a curved locating rod 34 extended from one end of the heavy pendulum 31 remote from the pivot hole 32. The free end 341 of the locating rod 34 has an outer diameter gradually reduced toward the end, and is inserted into the locating hole 24.

Referring to FIG. 2, the sliding tube 22 is slidably inserted into the sleeve 10, and the heavy pendulum 31 of the gravity-induced locating element 30 is constantly maintained perpendicular to the ground because of the effect of its weight W. When the travel bag is maintained standing still, the sliding tube 22, the sleeve 10, and the gravity center of the heavy pendulum 31 are maintained axially in a parallel relation, and the free end 341 of the curved locating rod 34 is maintained within the locating hole 24, therefore the sliding tube 22 automatically falls to the inside of the sleeve 10 from the extended position to the retracted position.

Figure 3:
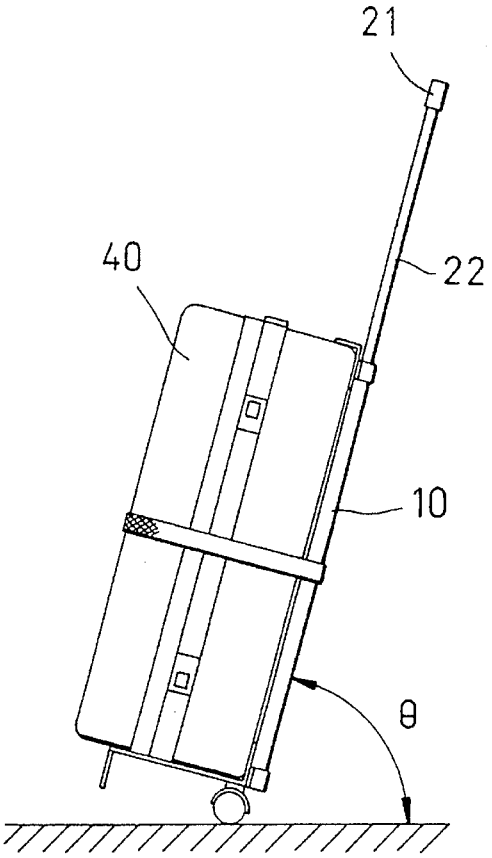
FIG. 3 shows the travel bag of FIG. 1 tilted.
Figure 4:
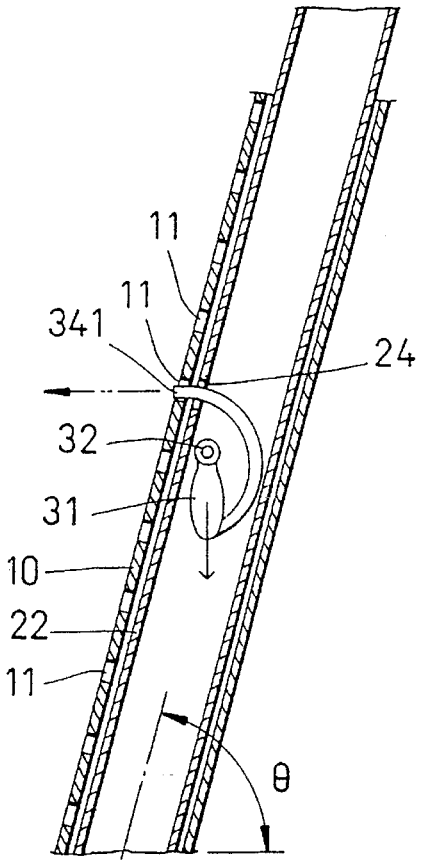
FIG. 4 shows the sleeve tilted and the sliding tube locked according to the present invention.

Referring to FIGS. 3 and 4, when the retracting handle 20 is pulled out of the sleeves 10 to the desired distance, the travel bag 40 is tilted to a tilted angle θ. When the travel bag 40 is tiled to the tilted angle θ, the sleeves 10 and the sliding tubes 22 are synchronously tilted. When the sliding tubes 22 are tilted, the curved locating rod 34 of each gravity-inducted locating element 30 is respectively forced by the gravity weight of the respective heavy pendulum 31 to move the respective free end 341 out of the respective locating hole 24 on the respective sliding tube 22 into one locating hole 11 on the respective sleeve 10, and therefore the sliding tubes 22 are locked in the retracted position. On the contrary, when the travel bag 40 is returned from the tilted position to the standing position (perpendicular to the ground), the free ends 341 of the curved locating rods 34 are pulled out of the respective locating holes 11 of sleeves 10 by the gravity weight of the heavy pendulums 31, and therefore the sliding tubes 22 are released from the sleeves 10 and can be moved in the sleeves 10.

Referring to FIG. 1 again, a vertical locating strip 42 is provided having two opposite ends 421 and 422 respectively secured to the top and bottom sides of the travel bag 40. A crossed connector 43 is fastened to the locating strip 42 in the middle to hold an endless binding strap 44, which is mounted around the travel bag 40 and the sleeves 10.

It is to be understood that the drawings are designed for purposes of illustration only, and are not intended as a definition of the limits and scope of the invention disclosed.

I claim:

1. A retractable handle locating structure comprising two sleeves adapted to be fixedly secured to the back side of a wheeled travel bag and disposed in a parallel relation, each sleeve having a longitudinal series of locating holes, a substantially U-shaped retracting handle having two sliding tubes slidably inserted into said sleeves and a transverse handgrip connected between said sliding tubes outside said sleeves, and lock means for locking said sliding tubes in an extended position relative to said sleeves, wherein said sleeves each has a longitudinal series of locating holes for engagement with said lock means; said lock means comprises two gravity-induced locating elements respectively mounted inside said sliding tubes, each gravity-induced locating element comprising a heavy pendulum having a fixed end pivotably connected to a pivot hole on one sliding tube and a free end connected with a curved locating rod, said curved locating rod having a fixed end connected to said heavy pendulum and a free end inserted into a locating hole on the respective sliding tube, the free end of said curved locating rod being forced in and out of one of the longitudinal series of locating holes on one sleeve by the gravity weight of said heavy pendulum when said travel bag is moved between a standing position perpendicular to the ground and a tilted position.

2. The retractable handle locating structure of claim 1 wherein the free end of said curved locating rod has an outer diameter gradually reduced toward the end.

* * * * *